US012753758B2

(12) United States Patent
Borlon

(10) Patent No.: US 12,753,758 B2
(45) Date of Patent: Oct. 6, 2026

(54) FLUID PUMP FOR AN AIRCRAFT TURBOMACHINE, LUBRICATION CIRCUIT AND AIRCRAFT TURBOMACHINE

(71) Applicant: SAFRAN AERO BOOSTERS, Herstal (BE)

(72) Inventor: Quentin Borlon, Herstal (BE)

(73) Assignee: SAFRAN AERO BOOSTERS, Herstal (BE)

( * ) Notice: Subject to any disclaimer, the term of this patent is extended or adjusted under 35 U.S.C. 154(b) by 0 days.

(21) Appl. No.: 18/852,036

(22) PCT Filed: Mar. 29, 2023

(86) PCT No.: PCT/EP2023/058140
§ 371 (c)(1),
(2) Date: Oct. 29, 2024

(87) PCT Pub. No.: WO2023/186981
PCT Pub. Date: Oct. 5, 2023

(65) Prior Publication Data

US 2025/0198309 A1 Jun. 19, 2025

(30) Foreign Application Priority Data

Apr. 1, 2022 (BE) ..... 2022/5245

(51) Int. Cl.
*F04C 2/344* (2006.01)
*F04C 2/08* (2006.01)
(Continued)

(52) U.S. Cl.
CPC ..... *F04C 2/3441* (2013.01); *F04C 2/086* (2013.01); *F04C 15/0049* (2013.01); *F04C 15/06* (2013.01); *F04C 2240/30* (2013.01)

(58) Field of Classification Search
CPC .... F04C 2/3441; F04C 2/086; F04C 15/0049; F04C 15/06; F04C 2240/30
See application file for complete search history.

(56) References Cited

U.S. PATENT DOCUMENTS 6,030,191 A 2/2000 Wood et al.
6,068,461 A * 5/2000 Haga ..... F04C 15/0049 418/259

(Continued)

OTHER PUBLICATIONS

International Search Report mailed Jul. 14, 2023, issued in corresponding International Application No. PCT/EP2023/058140, filed Mar. 29, 2023, 7 pages.

*Primary Examiner* — Mary A Davis
(74) *Attorney, Agent, or Firm* — CHRISTENSEN O'CONNOR JOHNSON KINDNESS PLLC

(57) ABSTRACT

A fluid pump for an aircraft turbomachine includes a ring through which a duct passes along a central axis, a rotor driven in rotation with respect to the ring along a main axis offset relative to the central axis. Cavities between the ring and the rotor have volumes that vary according to the angular position of the rotor with respect to the ring. The pump further includes an inlet space for admitting the fluid into the cavities and a discharge space for discharging the fluid from the cavities, the pressure in the discharge space being higher than the pressure in the inlet space. A groove pressurizes the cavities in the discharge space when the rotor rotates.

11 Claims, 3 Drawing Sheets

(51) Int. Cl.
*F04C 15/00* (2006.01)
*F04C 15/06* (2006.01)

(56) References Cited

U.S. PATENT DOCUMENTS

| | | | | |
|---|---|---|---|---|
| 11,473,575 | B2 * | 10/2022 | Williamson | F04C 15/008 |
| 2002/0054822 | A1 | 5/2002 | Watanable et al. | |
| 2005/0019196 | A1 | 1/2005 | Enzaka et al. | |
| 2015/0078948 | A1 | 3/2015 | Yoshida et al. | |
| 2017/0009776 | A1 | 1/2017 | Gomanne et al. | |

* cited by examiner

FLUID PUMP FOR AN AIRCRAFT TURBOMACHINE, LUBRICATION CIRCUIT AND AIRCRAFT TURBOMACHINE

FIELD OF THE DISCLOSURE

The present disclosure relates to a fluid pump for aircraft turbomachine, a lubrication circuit with such a pump and an aircraft turbomachine with such a lubrication circuit.

BACKGROUND

The aircraft turbojet engines have a large amount of mechanical items of equipment that needs to be lubricated or cooled, including shafts, bearings and gears. To achieve this, these turbojet engines are equipped with a lubrication circuit that allows to supply oil to each items of equipment. A supply pump generates a flow rate of oil which is then divided between several lines to supply the various items of equipment of the engine.

To save oil, this lubrication circuit operates as a closed circuit, with the oil delivered to each items of equipment being recovered and then reinjected into the lubrication circuit by recovery pumps.

The increase in flow rates and output pressures of the pumps used to supply the engine (oil tank towards engine enclosure) means that new hydraulic phenomena need to be controlled.

One of the phenomena that needs to be controlled is pressure pulsation at the outlet of the lubrication unit. As the aeronautical pumps are positive displacement pumps, they provide a flow rate. The outlet pressure is the result of pressure drops in the downstream circuit and the required flow rate.

As a result, the pressure pulses revert to flow rate pulses. If the discharged flow rate is not constant, then there will also be pressure variations (or pulsations) at the outlet of the lubrication unit. These pulsations may be due to the compressibility of the fluid.

The pulsations are harmful in several respects, in particular to the casing of the lubrication unit and to the oil circuit equipment items downstream of the lubrication unit (such as the filters, valves, heat exchangers, pipes, etc.).

The disadvantage of current lubrication units is that they are prone to premature breakage (pulsation fatigue) of one or more of the items of equipment of the units. To avoid such breakage, some of today's lubrication units have oversized items of equipment-which leads to an overall increase in the weight of the engine.

There is therefore a need to reduce or even eliminate the pressure pulsations.

SUMMARY

To this end, the disclosure proposes a fluid pump for an aircraft turbomachine, comprising a ring through which a duct passes along a central axis, a rotor driven in rotation relative to the ring along a main axis offset from the central axis, cavities between the ring and the rotor, the volume of the cavities varying according to the angular position of the rotor relative to the ring, an inlet space for admitting the fluid into the cavities and a discharge space for discharging the fluid from the cavities, the pressure in the discharge space being higher than the pressure in the inlet space, a groove exposing the cavities to the pressure of the discharge space as the rotor rotates.

Preferably, the ring is immobile and comprises a wall, the discharge and inlet spaces being radial and passing through the wall, and the groove passes radially through the wall and opens into the discharge space.

In one variant, the groove has an elongated shape along a circumference of the wall.

In one variant, the groove 15 has a length and a height, the length being greater than 110% of the height.

In one embodiment, the pump further comprises a sealing area between the fluid inlet space and the fluid discharge space, the groove extending over a portion of the sealing area.

In one variant, the groove opens into the discharge space, upstream or downstream of the discharge space, in the direction of rotation of the rotor.

In one embodiment, the wall comprises a sealing area between the fluid inlet space and the fluid discharge space, the groove extending over a portion of the sealing area.

According to one variant, the pump comprises a plurality of discharge spaces each with a groove passing radially through the wall of the ring and opening into the respective discharge space, the cumulative height of the grooves in the axial direction of the ring is between 1 and 15% of the height of the ring in the direction of the central axis.

In one variant, the groove or grooves are obtained by a milling, electro erosion or wire-cutting method.

In one embodiment, the pump comprises pallets movable on the rotor in a radial direction of the rotor and extending to the ring, the pallets defining the cavities between them.

The disclosure also relates to a lubrication circuit for lubricating an aircraft turbomachine, comprising at least one pump as described above, the groove exposing the cavities to the pressure of the discharge space and to the pressure of the circuit downstream of the pump.

The disclosure also relates to an aircraft turbomachine, comprising the lubrication circuit as described above.

The use of the verb "comprise" and its variants, as well as its conjugations in this document, may not in any way exclude the presence of elements other than those mentioned. The use in this document of the indefinite article "a", "an", or the definite article "the" to introduce an element does not exclude the presence of a plurality of these elements.

The terms "first", "second", "third", etc. are used in this scope of this document exclusively to differentiate between different elements, without implying any order between these elements.

All the preferred embodiments and all the advantages of the ring apply mutatis mutandis to the pump, the lubrication circuit and the turbomachine- and vice versa. The various embodiments may be considered individually or in combination.

DESCRIPTION OF THE DRAWINGS

Further characteristics and advantages of the present disclosure will become apparent from the following detailed description, for the understanding of which reference is made to the attached figures which show.

Figure 1:
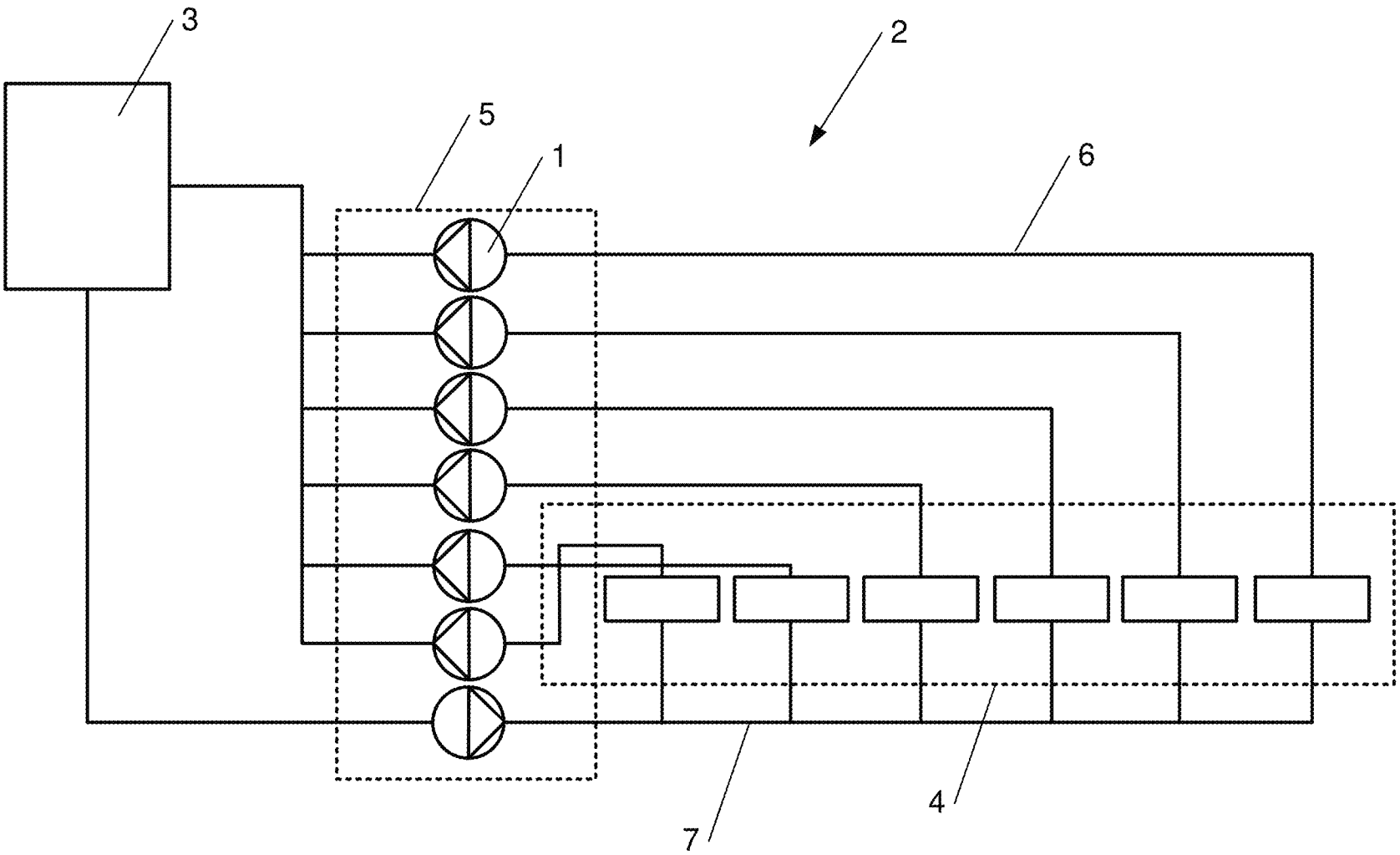
FIG. 1, a schematic view of a lubrication circuit.

The drawings in the figures are not to scale. Similar elements are generally denoted by similar references in the figures. In the scope of this document, the same or similar elements may have the same references. Furthermore, the presence of reference numbers or letters in the drawings may not be considered as limiting, even when these numbers or letters are indicated in the claims.

DETAILED DESCRIPTION

The disclosure relates to a fluid pump for an aircraft turbomachine, comprising a ring through which a duct passes along a central axis, a rotor driven in rotation relative to the ring along a main axis offset relative to the central axis, cavities between the ring and the rotor, the volume of the cavities varying according to the angular position of the rotor relative to the ring, an inlet space for admitting the fluid into the cavities and a discharge space for discharging the fluid from the cavities, the pressure in the discharge space being higher than the pressure in the inlet space. The pump also comprises a groove that exposes the cavities to the pressure of the discharge space when the rotor rotates. Such a groove allows the pump cavities to be pressurized to outlet pressure, thereby allowing to reduce or even eliminate pressure pulsations at the pump outlet. Over time, the service lifetime of the parts of the pump increases.

FIG. 1 illustrates a lubrication circuit 2 for an aircraft turbomachine. The circuit 2 is used to cool and/or lubricate the various items of equipment of the turbomachine. Within the circuit 2, the oil is sent from the tank 3 towards the items of equipment 4 on the turbomachine, such as bearings or enclosures. The circuit 2 comprises a lubrication unit 5 comprising circulation pumps 1 whose technology may vary. In the present description, these are, for example, desmodromic pallet pumps 1 or gerotor pumps 1. The pumps 1 supply oil to the items of equipment 4 via supply lines 6. Downstream of the items of equipment 4, recovery lines 7 allow to recover the oil and recirculate it in the circuit 2. There may be one pump 1 for each item of equipment 4 upstream and downstream of the items of equipment 4, or one pump 1 for several items of equipment 4 upstream and downstream of the item of equipment 4. According to the embodiment in FIG. 1 by way of example, one pump 1 is provided for each upstream item of equipment 4 and a single pump 1 downstream for all the items of equipment 4.

Figure 2:
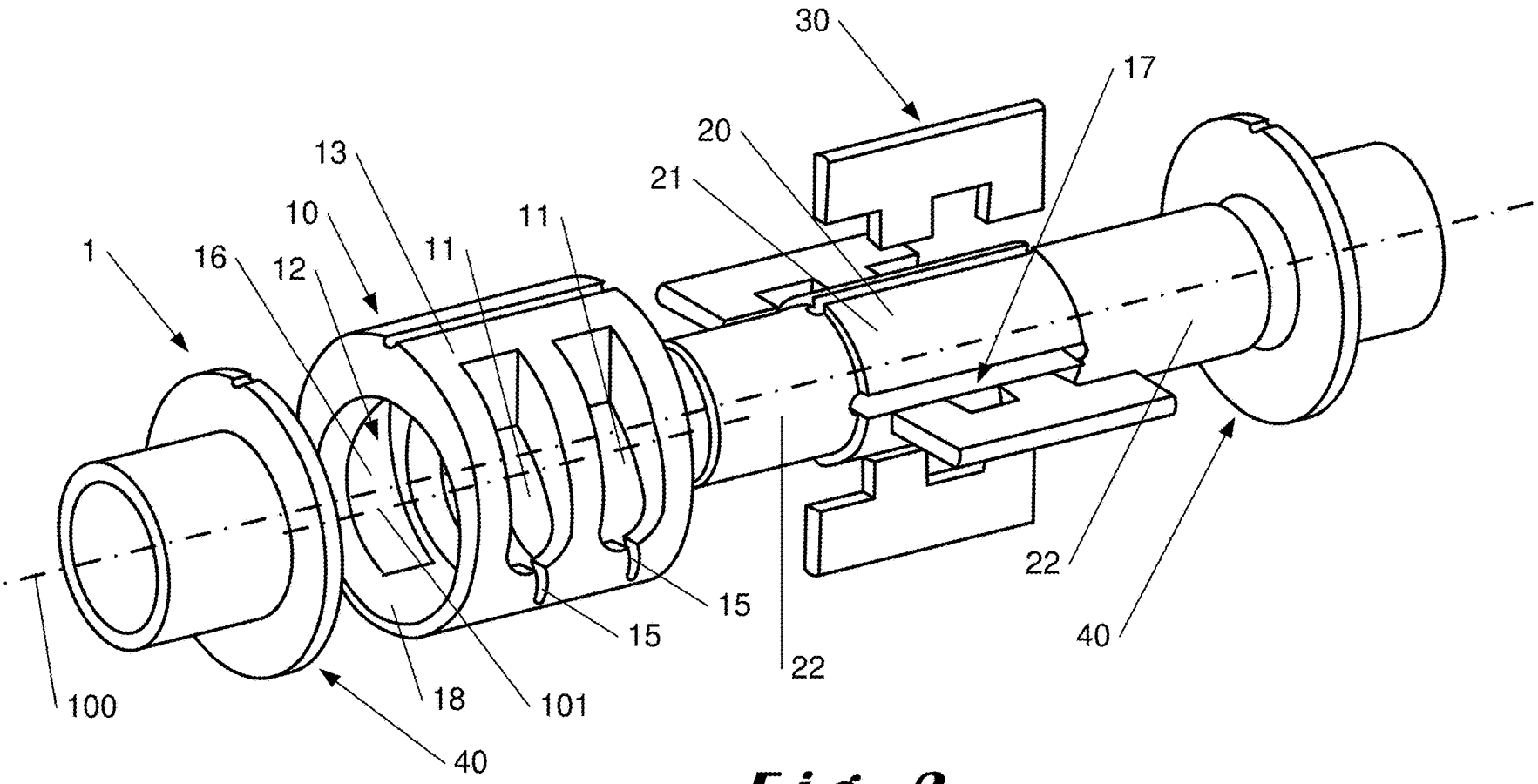
FIG. 2, a perspective view of an example of embodiment of a fluid pump.

FIG. 2 shows a perspective view of an example of embodiment of a pump 1 which is a desmodromic pallet pump. The pump 1 is a positive displacement pump, which imposes a flow rate. The pump 1 comprises a ring 10 (or cam for such a pump) with a generally rotationally cylindrical external shape. The ring 10 comprises an axial cylindrical duct 12 passing through the ring 10 along a central axis 101. The ring 10 is immobile. The ring 10 is bounded radially by a wall 13. The ring 10 also comprises a fluid inlet space 16 (or inlet opening) and a fluid discharge space 11 (or discharge opening)—in particular for lubricating fluid—the spaces 11 and 16 being radial and passing through the wall 13. The pressure in the discharge space 11 is higher than the pressure in the inlet space 16; in other words, the discharge space 11 is at high pressure, to discharge the fluid towards the pump outlet, and the inlet space 16 is at low pressure to admit the fluid from the pump inlet. The ring 10 may comprise one or more inlet spaces 16 and discharge spaces 11, distributed along the main axis 100. Two inlet spaces 16 and two discharge spaces 11 are shown by way of example in the figures; according to another example, the ring 10 may comprise two inlet spaces 16—coming from different lines—and one discharge space 11—returning the fluid towards a single line. The spaces 11 and 16 extend along a certain angular sector, so as to put different cavities of duct 12 in communication with the outside.

The pump 1 also comprises a rotor 20 (or shaft) movable in rotation about a main axis 100 that is parallel to but eccentric relative to the central axis 101. The rotor 20 extends along the main axis 100 and passes longitudinally through the duct 12 of the ring 10. The rotor 20 comprises a drum 21 supporting pallets 30. The rotor 20 is supported by trunnions 22 on either side of the drum 21 along the axis 100. The trunnions 22 are each rotatably mounted on bearings 40. The pallets 30 are radial, extending along a radius of the rotor 20, in a plane containing the main axis 100. The pallets 30 are inserted into slots 17 in the drum 21, extending radially in the drum 21, in a plane containing the main axis 100. There are four pallets 30 in FIG. 2, by way of example; the pallets 30 may be more, for example six or eight.

The pallets 30 delimit the cavities of the duct 12 in communication with the outside, through the spaces 11 and 16. A cavity is bounded between two consecutive pallets, along an angular sector of the duct 12 centered on the main axis 100. A cavity admits the fluid when the cavity faces an inlet space 16; a cavity discharges the fluid when the cavity faces a discharge opening 11.

The internal surface of the duct 12 of the ring 10 forms a cam surface 18 which, as the rotor 12 rotates, acts on the pallets 30—due to the offset between the main axis 100 of rotation of the rotor 20 and the central axis 101 of the duct 12. For a given pallet 30, as the distance between the rotor 12 and the cam surface 18 decreases, the cam surface 18 pushes the pallet 30 towards the inside of the drum 21, thus maintaining the seal at the end of the vane 30, between two consecutive cavities. Then, for a certain pallet 30, as the distance between the rotor 12 and the cam surface 18 increases, the pallet 30 is urged towards the outside of the drum 21 against the ring surface 18, also maintaining the seal at the end of the pallet 30. The 20 pallets 30 are pressed against the cam surface 18 by various possible means, for example by springs not shown. The volume of the cavities therefore varies according to the angular position of the rotor 20 relative to the ring 10.

As the rotor 20 rotates about the main axis 100, the fluid such as oil enters through an inlet space 16 into a cavity inside the duct 12, delimited by two consecutive pallets 30. The rotation of the rotor 20 drives the cavity towards a discharge space 11, increasing the pressure of the fluid by reducing the volume of the cavity.

Figure 3:
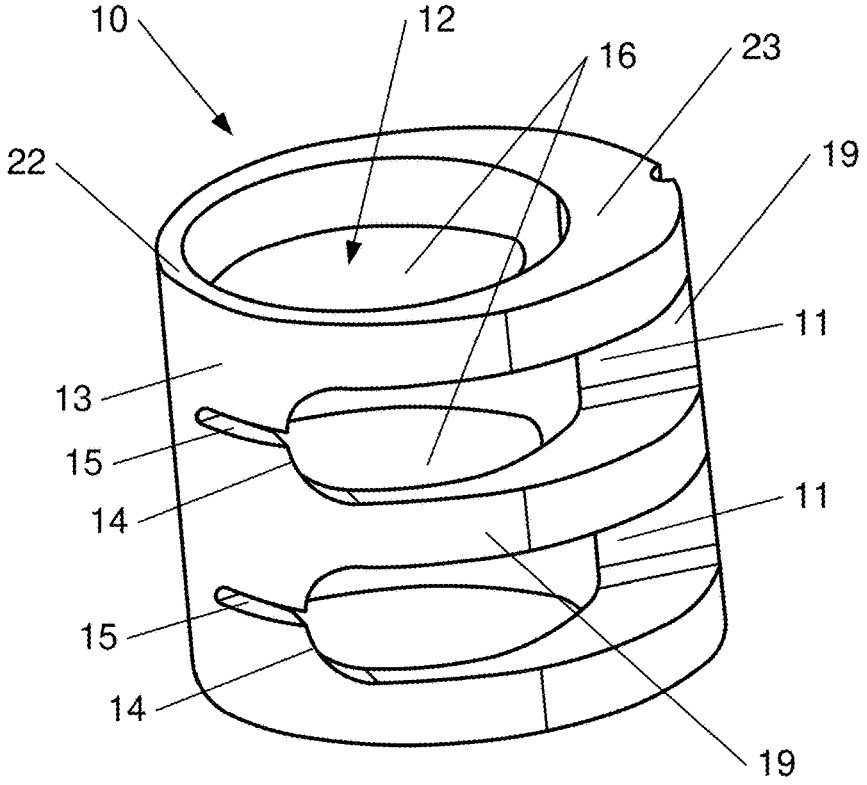
FIG. 3, a perspective view of an example of embodiment of a ring of the pump in FIG. 2.
Figure 4:
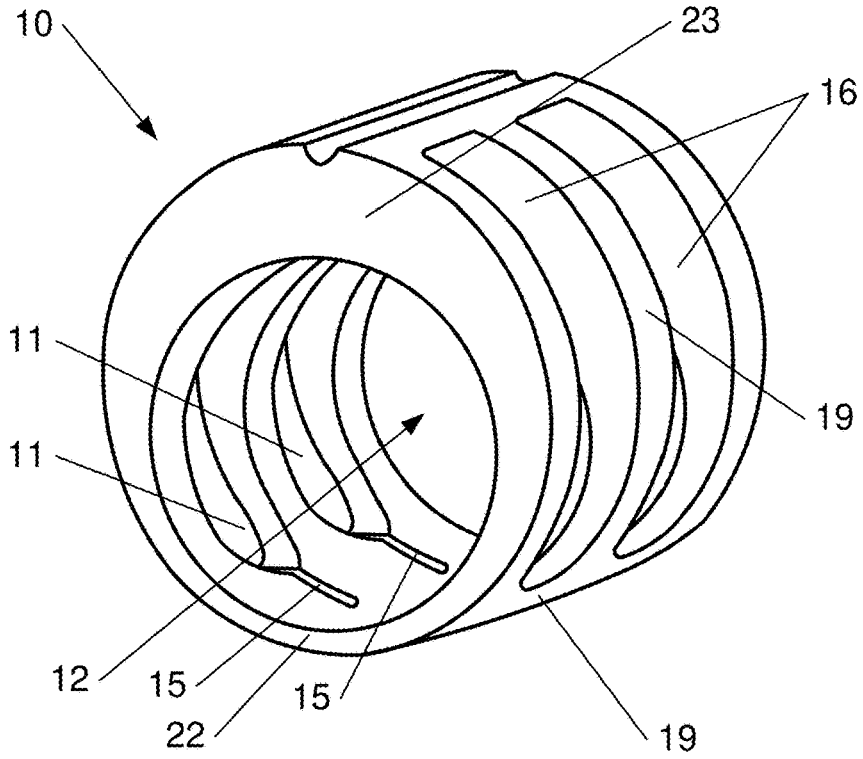
FIG. 4, another perspective view of an example of embodiment of a ring of the pump in FIG. 2.

FIGS. 3 and 4 show a perspective view of an example of embodiment of the ring 10 of the pump 1. Between two inlet 16 and discharge 11 spaces located on the same circumference of the ring, the ring 10 comprises a sealing area 19 defined by the wall 13. Thus, when the fluid is admitted to a cavity through an inlet space 16, the fluid may not leak from the cavity when the latter is driven in rotation by the rotor and faces the sealing area 19; the fluid is only discharged when the cavity faces the discharge space 11. Because of the offset between the axes 100 and 101, the ring 10 comprises a portion 23 of thicker wall 13 and a portion 22 of thinner wall 13; each of the portions 23 and 22 comprises a sealing area 19. Similarly, between two inlet spaces 16 and between two discharge spaces 11 along the main axis 100, the ring 10 comprises a sealing area 19 defined by the wall 13. In this way, the fluid admitted to a cavity opposite an inlet space 16 may not leak towards an adjacent cavity along the main axis 100.

When the fluid is discharged from the duct through a discharge space 11, a pressure pulsation occurs. As the pump 1 is a positive displacement pump, it provides a flow rate. The outlet pressure is the result of pressure drops in the downstream circuit and the required flow rate. As a result, the pressure pulses revert to flow rate pulses. If the discharged flow rate is not constant, there will also be pressure variations (pulsations) at the outlet of the lubrication unit 5. These pulsations may be due to the compressibility of the fluid. To reduce or even eliminate the pressure pulsations, the ring 10 comprises a groove 15 visible in the figures, which exposes the cavities to the pressure of the discharge space 11 when the rotor 20 rotates. Such a groove 15 ensures that the cavity of the duct 12 is gradually pressurized before the fluid is discharged. This allows to avoid the premature breakage of one or more items of equipment in the oil circuit and also avoids oversizing items of equipment to prevent breakage.

As the cavity is already at high pressure when it discharges, the reduction in the cavity volume as the rotor 20 rotates means that the fluid may be discharged directly. Without the grooves 15, the first moments of reduction in the volume of the cavity only serve to pressurize the fluid (by compression/reduction of the volume of the cavity). There is therefore a delay during which the cavity does not discharge, leading to variations in flow rate (and therefore pressure pulsations) at the outlet of the pump 1. The presence of the grooves 15 therefore helps to initiate a discharging and reduce, or even cancel out, the pressure pulsations.

More specifically, the groove 15 passes radially through the wall 13 and opens into the discharge space 11, along the circumference of the ring 10. The groove 15 extends over a portion of the sealing area 19 defined in the wall 13 between a fluid inlet space 16 and a fluid discharge space 11. The presence of the groove 15 in the sealing area breaks the seal between the inlet and the outlet of a fluid cavity, but allows the cavity to be pressurized before it is discharged towards the discharge space 11. In other words, depending on the direction of rotation of the rotor 20 in the duct 12, the fluid is admitted through an inlet space 16 into a cavity between two pallets 30, then the cavity is directed towards a discharge space 11; the groove 15 being in the sealing area between the inlet space 16 and the discharge space 11, upstream of the discharge space 11, the groove allows to bring the cavity of the pump to outlet pressure while limiting leaks and the discharge of the fluid.

According to FIGS. 3 and 4, the grooves 15 are at one end 14 of the discharge spaces 11, upstream of the discharge spaces 11. This is the end first reached by the cavity of the duct or during the rotational movement of the rotor 20. Alternatively or in combination, the grooves 15 may also be located at one end of the discharge spaces 11, downstream of the discharge spaces 11. The presence of the groove shape opening into the discharge space allows progressive pressure variations in the discharge space. The presence of the groove or grooves upstream and/or downstream allows a gradual variation in the cavity pressure and reduces the mechanical loads on the elements of the lubrication circuit caused by sudden pressure variations.

The dimensions of a groove 15 are small enough to limit leakage (or a return flow rate) while ensuring a gradual pressurization of the cavity before it is discharged. A too large groove would lead to unacceptable leakage, whereas a too small groove would have no effect on pressurizing the cavity. To achieve this, the cumulative height of the grooves 15 is between 1 and 15% of the height of the ring 10. The groove 15 has an elongated shape. The groove 15 is an elongated orifice. The groove 15 is elongated around the circumference of the ring 10 (and of the wall 13). The groove 15 is a longitudinal notch in the wall 13. The groove 15 is a longitudinal notch in the wall 13, along the circumference of the ring 10. The groove 15 has a larger dimension in one direction (circumferential of the ring 10 and the wall 13) than in another direction (along the central axis 101 of the ring 10). The groove 15 has a length and a height, the length being greater than 110% of the height. The length of the groove 15 is a circumferential dimension of the ring 10 (and of the wall 13). In other words, the length of the groove 15 is along a directrix of the cylindrical ring 10. The height of the groove 15 is a dimension along the central axis 101 of the ring 10. In other words, the height of the groove 15 is along a generatrix of the cylindrical ring 10. The groove 15 passes radially through wall 13 and opens out at one end of its largest dimension into the discharge space 11, along the circumference of the ring 10. The groove is an orifice that is long in one direction and narrow in another. The shape and the arrangement of the groove through the wall and in relation to the discharge space 11 ensures progressive pressurization of the cavity before it is discharged. Alternatively or in combination, the shape and the arrangement of the groove through the wall and in relation to the discharge space 11 ensures a gradual variation in the cavity pressure after discharge.

The grooves 15 are positioned at the end of the sealing area 19 upstream of the discharge space 11, in the direction of rotation of the rotor 20. This sealing area 19 may, depending on the design of the ring 10, correspond to the thinner portion 22 of the wall 13 (as may be seen in FIGS. 3 and 4) but may also be in the thicker portion 23 of the wall 13. The grooves 15 may also be positioned at the start of the sealing area 19, downstream of the discharge space 11, in the direction of rotation of the rotor 20.

The grooves 15 may, for example, be obtained by a milling, electro erosion or wire-cutting method, allowing the dimensions of the grooves to be controlled and appropriate dimensions to be obtained. A too large groove would lead to unacceptable leakage, whereas a too small groove would have no effect on pressurizing the cavity.

The elements of the pump 1, such as the rotor 20, the journals 22, the drum 21, the pallets 30 and the ring 10, may be made of steel; the bearings 40 may be made of bronze.

The disclosure also relates to the lubrication circuit 2 comprising the pump 1 and an aircraft turbomachine. The grooves 15 allow to reduce or even eliminate the pressure pulsations in the lubrication circuit. This has no impact on the interfaces with the pump. This also allows to improve a fluid circulation and prevents premature breakage of one or more items of equipment in the oil circuit. This means longer equipment service lifetime. We also avoid oversizing the items of equipment and thus increasing the overall weight of the turbomachine.

The present disclosure has been described above in connection with specific embodiments, which are illustrative and should not be considered limiting. In general, it will be apparent to a person skilled in the art that the present disclosure is not limited to the examples illustrated and/or described above.

The invention claimed is:

1. A fluid pump for an aircraft turbomachine, comprising:

a ring through which a duct passes along a central axis, the ring being immobile and comprising a wall, a rotor driven in rotation relative to the ring along a main axis offset from the central axis, cavities between the ring and the rotor, a volume of the cavities varying according to an angular position of the rotor relative to the ring, an inlet space configured to admit a fluid into the cavities and a discharge space configured to discharge the fluid from the cavities, a pressure in the discharge space being higher than a pressure in the inlet space, the discharge and inlet spaces being radial and passing through the wall, and a groove exposing the cavities to the pressure of the discharge space as the rotor rotates, the groove passing radially through the wall and opening into the discharge space, the groove having an elongate shape along a circumference of the wall.

2. The pump according to claim 1, wherein the groove has a length and a height, the length being greater than 110% of the height.

3. The pump according to claim 1, further comprising a sealing area between the fluid inlet space and the fluid discharge space, the groove extending over a portion of the sealing area.

4. The pump according to claim 1, wherein the groove opens into the discharge space, upstream or downstream of the discharge space, in a direction of rotation of the rotor.

5. The pump according to claim 1, wherein the wall comprises a sealing area between the fluid inlet space and the fluid discharge space, the groove extending over a portion of the sealing area.

6. The pump according to claim 1, further comprising a plurality of discharge spaces, each with a groove passing radially through the wall of the ring and opening into the corresponding discharge space, a cumulative height of the grooves in an axial direction of the ring being between 1 and 15% of a height of the ring in a direction of the central axis.

7. The pump according to claim 1, wherein the groove is formed by a milling, electro erosion, or a wire-cutting method.

8. The pump according to claim 1, further comprising pallets movable on the rotor in a radial direction of the rotor, and extending to the ring, the pallets defining the cavities between them.

9. The pump according to claim 1, wherein the groove comprises a plurality of grooves that are formed by milling, electro erosion, or a wire-cutting method.

10. A lubrication circuit for lubricating an aircraft turbomachine, comprising at least one pump, the pump comprising:

a ring through which a duct passes along a central axis, the ring being immobile and comprising a wall, a rotor driven in rotation relative to the ring along a main axis offset from the central axis, cavities between the ring and the rotor, a volume of the cavities varying according to an angular position of the rotor relative to the ring, an inlet space configured to admit a fluid into the cavities and a discharge space configured to discharge the fluid from the cavities, a pressure in the discharge space being higher than a pressure in the inlet space, the discharge and inlet spaces being radial and passing through the wall, and a groove exposing the cavities to the pressure of the discharge space as the rotor rotates and to a pressure of the circuit downstream of the pump, the groove passing radially through the wall and opening into the discharge space, the groove having an elongate shape along a circumference of the wall.

11. An aircraft turbomachine, comprising a lubrication circuit having at least one pump, the pump comprising:

a ring through which a duct passes along a central axis, the ring being immobile and comprising a wall, a rotor driven in rotation relative to the ring along a main axis offset from the central axis, cavities between the ring and the rotor, a volume of the cavities varying according to an angular position of the rotor relative to the ring, an inlet space configured to admit the fluid into the cavities and a discharge space configured to discharge the fluid from the cavities, a pressure in the discharge space being higher than a pressure in the inlet space, the discharge and inlet spaces being radial and passing through the wall, and a groove exposing the cavities to the pressure of the discharge space as the rotor rotates and to a pressure of the circuit downstream of the pump, the groove passing radially through the wall and opening into the discharge space, the groove having an elongate shape along a circumference of the wall.

* * * * *